United States Patent [19]

Cummins

[11] Patent Number: 4,488,082

[45] Date of Patent: Dec. 11, 1984

[54] BI-FITTED INCANDESCENT ELECTRIC LIGHT BULBS WITH INTERNAL ELECTRICALLY PARALLEL CONDUCTORS

[75] Inventor: Millard Cummins, Columbus, Ohio

[73] Assignee: Invocas, Inc., Columbus, Ohio

[21] Appl. No.: 459,982

[22] Filed: Jan. 21, 1983

[51] Int. Cl.[3] ..... H01J 5/48; H01J 5/50

[52] U.S. Cl. ..... 313/318; 339/165; 339/50 R; 339/47 R; 313/315; 313/1; 313/3; 362/184

[58] Field of Search ..... 339/47 R, 49 R, 50 R, 339/144, 165, 164, 185 RL; 313/315, 318, 1, 3; 362/184

[56] References Cited

U.S. PATENT DOCUMENTS

| | | | |
|---|---|---|---|
| 929,280 | 7/1909 | Broadwell et al. | 313/318 |
| 1,017,263 | 2/1912 | Kitsee | 313/315 |
| 1,048,017 | 12/1912 | Willard | 313/113 |
| 1,169,346 | 1/1916 | O'Donnell | 313/315 |
| 1,229,474 | 6/1917 | Kenyon | 313/113 |
| 1,439,471 | 12/1922 | Hohl | 313/318 |
| 1,644,744 | 10/1927 | Pingen | 313/318 |
| 1,965,784 | 7/1934 | Utrecht | 339/165 |
| 1,994,219 | 3/1935 | Hollmann | 313/318 |
| 2,071,874 | 2/1937 | Dobben et al. | 313/318 X |
| 2,071,948 | 2/1937 | Peters | 313/318 |
| 2,108,632 | 2/1938 | Weston | 339/165 |
| 2,427,711 | 9/1947 | Cartun | 313/318 |
| 2,651,024 | 9/1953 | Miller | 339/55 |
| 2,652,483 | 9/1953 | Laidig et al. | 240/51.12 |
| 2,900,552 | 8/1958 | Pennow | 313/220 |
| 3,028,523 | 4/1962 | Seid | 315/71 |
| 3,265,923 | 8/1966 | Presziosi et al. | 313/318 |
| 3,278,787 | 10/1966 | Bustamante | 313/204 |
| 3,402,383 | 9/1968 | Hilzen | 339/112 |
| 3,633,023 | 1/1972 | Castiglioni et al. | 313/1 |

*Primary Examiner*—Saxfield Chatmon

*Attorney, Agent, or Firm*—Cushman, Darby & Cushman

[57] ABSTRACT

An incandescent electric light bulb is provided with two fittings, typically two opposed screw-threaded bases, each with two terminals. The bulb is provided with internal parallel conductors between corresponding terminals of the two fittings. One or more incandescent filaments is or are connected between the conductors within the bulb. Accordingly several of the bulbs may be connected fitting-to-fitting, electrically in parallel, with or without inter-bulb connectors, with no need for externally wired sockets between adjoining bulbs. Various fittings, connectors and supports are described.

22 Claims, 12 Drawing Figures

Fig. 1
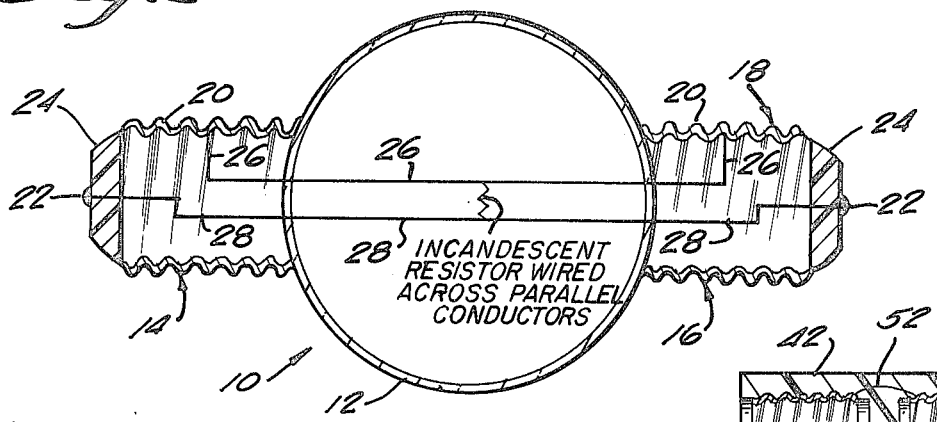
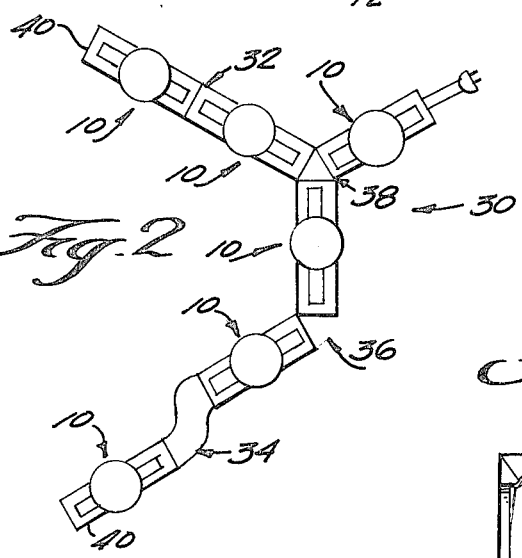
Fig. 2
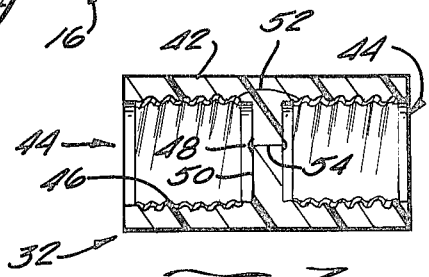
Fig. 3
Fig. 4
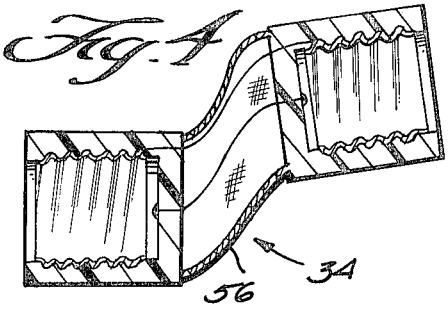
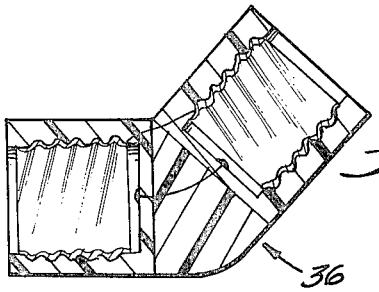
Fig. 5
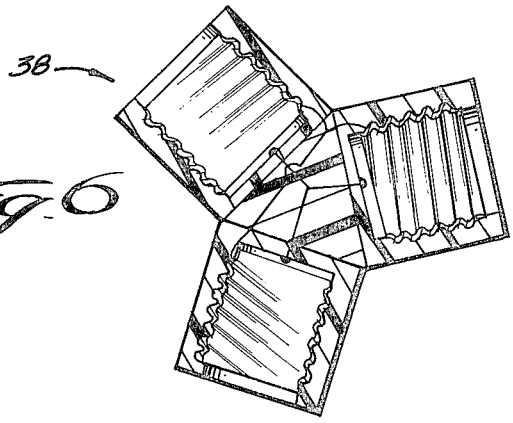
Fig. 6
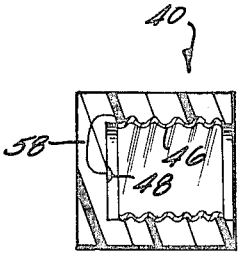
Fig. 7

BI-FITTED INCANDESCENT ELECTRIC LIGHT BULBS WITH INTERNAL ELECTRICALLY PARALLEL CONDUCTORS

BACKGROUND OF THE INVENTION

In the typical conventional incandescent light bulb a resistor which will glow incandescently when served with electricity is encapsulated within an evacuated or noble gas-filled glass envelope. Two leads to opposite ends of the resistor sealingly pierce the glass envelope. Usually the bulb is provided with a fitting which combines a mechanical mounting means for the bulb as well as electrical terminals for the two leads, separated by a body of electrically insulating material. Typically the glowing resistor is provided in the form of one or more very fine filamentary strands of a tough, ductile metal such as tungsten. One or both leads of the incandescent filament may incorporate a fuse which is arranged to interrupt or irreversibly sever the electrical circuit through the bulb should an abnormally high voltage be placed across the bulbs leads. Most frequently on incandescent electric light bulbs meant for household and office interior lighting the single fitting of the bulb takes the form of an externally threaded cylindrical base securely externally mounted to the glass envelope. On such bulbs, usually one resistor lead is terminated to the screw-threaded metal collar which forms the sidewall of the base and the other resistor lead is terminated to a boss that is centrally located on the outer end wall of the base. Dielectric material is provided in an annulus closing the space between the boss and the metal collar at the outer end of the bulb base.

In order to use such a bulb, generally it is necessary to screw its base into a socket which has two corresponding, electrically isolated center and peripheral terminals.

Where two or more such bulbs are to be connected in the same electrical circuit, conventionally it is necessary to wire a corresponding number of sockets into the same circuit, and to screw the base of a respective bulb into each. Although the sockets may be serially wired along the circuit, more typically each is wired across the circuit, particularly so that if the light-producing element of one bulb fails the circuit will not be interrupted as to the remaining bulbs and they will continue to be served with electricity.

Although they appear to be rare in the marketplace, double-ended or bifitted incandescent electric light bulbs are known in the art. Generally such bulbs include two diametrically opposed bases, each provided with a respective single electrical terminal for each glowing resistor. Whereas such bulbs may be connected in plurality, base-to-base in series with or without the use of separable intervening bulb-to-bulb connectors, such bulbs cannot be connected in a circuit in parallel to one another without the use of sockets wired in parallel with one another in an electrical circuit which is disposed externally of the light bulbs.

SUMMARY OF THE INVENTION

An incandescent electric light bulb is provided with two fittings, typically two opposed screw-threaded bases, each with two terminals. The bulb is provided with internal parallel conductors between corresponding terminals of the two fittings. One or more incandescent filaments is or are connected between the conductors within the bulb. Accordingly, several of the bulbs may be connected fitting-to-fitting, electrically in parallel, with or without inter-bulb connectors, with no need for externally wired sockets between adjoining bulbs. Various fittings, connectors and supports are described.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the Drawings

FIG. 1 is a somewhat schematic longitudinal sectional view of a first embodiment of the bifitted incandescent electric light bulb with internal electrically parallel conductors;

FIG. 2 is a schematic view of an electrical circuit incorporating several of the bulbs of FIG. 1, and exemplary bulb-to-bulb connectors and fitting terminators;

FIGS. 3, 4, 5, 6 and 7 are respective somewhat schematic longitudinal sectional views of the bulb-to-bulb connectors and fitting terminators shown in FIG. 2;

DETAILED DESCRIPTION

Figure 8:
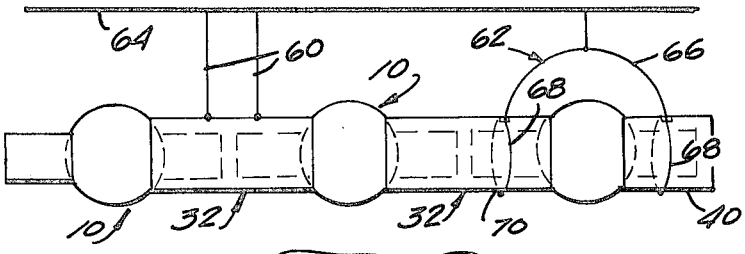
FIG. 8 is a somewhat schematic fragmentary side elevational view showing a portion of the installation depicted in FIG. 2, further including two different forms of mechanical suspension hangers for the installation.

In FIG. 1, a bifitted incandescent electric light bulb 10 according to a first embodiment of the invention is shown by itself. In the instance of this embodiment the glass envelope 12 is externally provided at two spaced apart (e.g. diametrically opposed) locations, with a respective two fittings 14, 16. In the instance depicted in FIG. 1, each of these fittings 14, 16 is identical to the other, and, for instance is like or similar to the conventional base for screw-into-socket type incandescent electric light bulbs. That is, each base is provided in the form of an external, generally cylindrical boss 18 where the sidewall is provided by a screw-threaded tubular collar 20 of electrically conductive material, e.g. brass and the outer end wall is provided by a center terminal boss 22 surrounded by a sealing annulus 24 of dielectric material.

Within the bulb envelope, a first electrical conductor 26 interconnects the two peripheral terminals 20 and a second electrical conductor 28 interconnects the two center terminals 22.

Because the fittings 14 and 16 are identical, the bulb 10 cannot be directly screwed together with another bulb 10 to provide a multibulb unit 30 that is mechanically connected in series whereas its individual bulbs are electrically connected in parallel. However, this may be simply accomplished with the use of interbulb connectors which are shown in FIG. 2. (In FIGS. 3–7 the different types of interbulb connectors 32, 34, 36 and 38 and the fitting terminator 40 all rudimentarily depicted in FIG. 2 are individually illustrated in somewhat greater detail.)

In the instance of each of the elements 32–38, a structural body 42, e.g. of electrically insulating material is provided with a plurality of fitting-receivers 44 which are spaced from one another on the body. Each fitting receiver 44 is shown provided to be in the nature of a respective socket having an internally threaded tubular, electrically conductive sidewall terminal 46, an inner end wall boss-like center terminal 48 of electrically conductive material, with an inner end wall annular mechanically bridging portion 50 of electrically insulating material. Within the body 42, respective isolated conductors 52, 54 electrically connect respective terminals 46, 48.

The illustrated bulb-connectors 32–38 differ from one another as to detail. For instance, the bulb connector 32 of FIG. 3 is straight and has a rigid body with two oppositely axially opening sockets; the bulb connector 34 of FIG. 4 is similar, but has a flexible intermediate body portion 56; the bulb connector 36 of FIG. 5 has a rigid body with two sockets set at an angle, e.g. at a right angle to one another in order to incorporate a corresponding degree of turn to the string of bulbs 10 incorporating that connector; and the bulb connector 38 of FIG. 6 includes a rigid body with three sockets set in a Y-pattern. These connectors are merely illustrative, since other patterns may be provided using the same principles.

The end or fitting terminator 40 shown in FIG. 7 is similar, except that it has but one socket, in which the peripheral terminal 46 is electrically connected to the center terminal 48 by a relatively low resistance conductor 58.

Mechanical hangers may be provided as illustrated in FIG. 8 where two types are shown at 60, 62. The hanger 60 may be constituted by one or more tensile rods or straps for connection between one of the connectors 32–38 and the ceiling, or the like 64. The other hanger 62 may be constituted by an elongated flexible strap 66, e.g. of fiber-reinforced flexible plastic material with a loop 68 integrally provided at each end each loop 68 is slipped over one end of a connector 32–38 or a terminator 40 and, e.g. seated in complementary, intermediately located notches 70. At the center of the arch thus formed, the hanger 62 may be hooked to the ceiling or the like 64.

Figure 9:
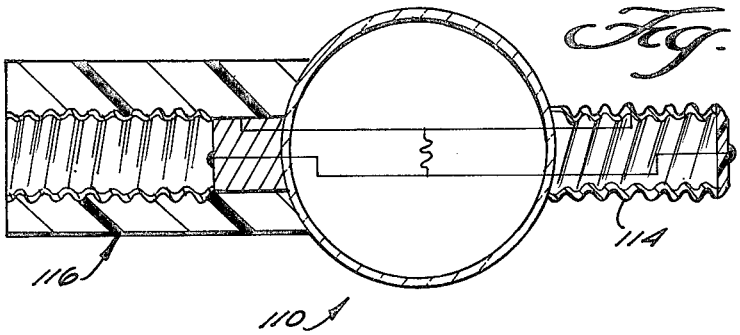
FIG. 9 is a somewhat schematic longitudinal sectional view of a second embodiment of the bulb.
Figure 10:
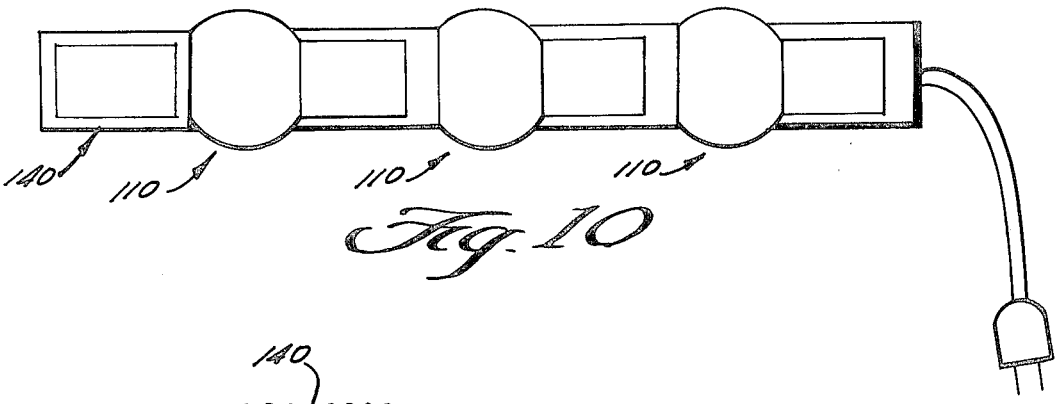
FIG. 10 is a schematic view of an electrical circuit incorporating several of the bulbs of FIG. 9.

A second embodiment of the bulb is illustrated at 110 in FIG. 9. This embodiment is like the one shown in FIG. 1, except that one of the cylindrical boss-type fittings 114 is replaced by a complementary socket-type fitting 116. Accordingly, except to execute corners, Y's and the like the bulbs 110 may be simply screwed together boss-to-socket, without the need for intervening connectors (FIG. 10). Where connectors are needed, e.g. to execute corners and Y's they may correspond to those shown in FIGS. 3–7, with some socket-type fittings of connectors replaced by complementary boss-type fittings.

Figure 11:
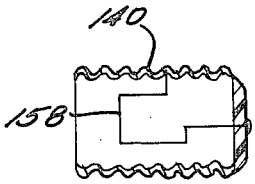
FIG. 11 is a somewhat schematic longitudinal sectional view of a fitting terminator shown in FIG. 10.

Likewise a fitting terminator 140 may be provided (FIG. 11) for terminating the socket-fitted end of a bulb 110. It is like the fitting 40 used for boss-fitted ends, except that its conductor 158 extends between the center and peripheral terminals of a complementary boss-type fitting.

Figure 12:
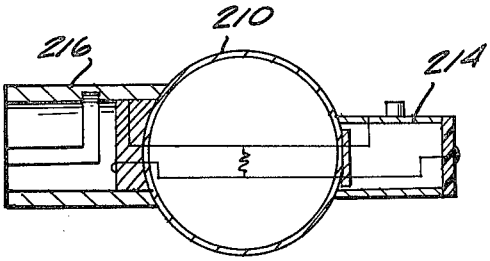
FIG. 12 is a somewhat schematic longitudinal sectional view of a third embodiment of the bulb.

A third embodiment of the bulb is shown at 210 in FIG. 12. Here, all that is different from the embodiment shown in FIG. 9 is that the screw-threaded boss-type and socket-type fittings are respectively replaced by corresponding lateral pin boss-type and J-slot socket-type fittings 214, 216.

The bifitted bulbs, connectors and fitting terminators shown in FIGS. 1–12 are illustrative of these and other types of mechanical and electrical elements and members which may be provided to make use of the principles of the invention.

It should now be apparent that the bi-fitted incandescent electric light bulbs with internal electrically parallel conductors as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A bifitted incandescent electric light bulb, comprising:

means constituting an envelope including light-transmitting wall means;

two fittings mechanically connected to the envelope as externally accessable accoutrements thereof, said two fittings being spaced from one another about the periphery of the envelope;

each fitting including a first and a second electrical terminal and dielectric means electrically insulating these terminals from one another;

two electrical conductors respectively wired in parallel within said envelope one between corresponding first electrical terminals of said two fittings and the other between corresponding second electrical terminals of said two fittings; and at least one incandescent filament means provided across said two electrical conductors within said envelope.

2. The bifitted incandescent electric light bulb of claim 1, wherein:

at least one of said fittings is constituted by a generally cylindrical base having a sidewall and an outer end wall, one of said electrical terminals thereof comprising an externally threaded tube of electrically conductive material providing at least a respective portion of said sidewall, and the other of said electrical terminals thereof comprising a centrally located boss of electrically conductive material providing a respective portion of said outer end wall, and said dielectric means being provided as an annulus mechanically bridging between said boss and said sidewall.

3. The bifitted incandescent electric light bulb of claim 2, wherein:

said at least one fitting is constituted by both of said fittings.

4. The bifitted incandescent electric light bulb of claim 2, wherein:

said at least one fitting is constituted by one of said fittings and the other of said fittings is constituted by means providing a generally cylindrical socket having a sidewall and an inner end wall, one of said electrical terminals thereof comprising an internally threaded tube of electrically conductive material providing at least a respective portion of said sidewall, and the other of said electrical terminals thereof comprising a centrally located boss of electrically conductive material providing a respective portion of said inner end wall, and said dielectric means being provided as an annulus mechanically bridging between said boss and said sidewall.

5. The bifitted incandescent electric light bulb of claim 1, wherein:

one of said fittings is constituted by a generally cylindrical base having a sidewall and an outer end wall, one of said electrical terminals thereof comprising a tube of electrically conductive material providing at least a respective portion of said sidewall, and the other of said electrical terminals thereof comprising a centrally located boss of electrically conductive material providing a respective portion of said outer end wall, and said dielectric means thereof being provided as an annulus mechanically bridging between said boss and said sidewall;

said one fitting further including a first mechanical connector means externally provided on said sidewall thereof;

the other of said fittings being constituted by means defining a generally cylindrical socket having a sidewall and an inner end wall, one of said electrical terminals thereof comprising a tube of electrically conductive material providing at least a respective portion of said sidewall, and the other of said electrical terminals thereof comprising a centrally located boss of electrically conductive material providing a respective portion of said inner end wall, and said dielectric means thereof being provided as an annulus mechanically bridging between said boss and said sidewall;

said other fitting further including a second mechanical connector means provided on said sidewall so as to be accessable from within said socket;

said one and other fittings corresponding to one another in a complementary manner so that said one fitting will accept and both electrically parallelly connect with and mechanically connect with the other fitting of an identical second such light bulb, and so that said other fitting of the first-described light bulb will be accepted by and both electrically parallelly connect with and mechanically connect with the one fitting of an identical third such light bulb.

6. The bifitted incandescent electric light bulb of claim 5, wherein:

said first and second mechanical connectors are constituted by the respective elements of a pin and J-slot bayonnet joint.

7. A lighting system of bifitted incandescent electric light bulbs, comprising:

at least two adjoining bifitted incandescent electric light bulbs, each including:

means constituting an envelope including light-transmitting wall means;

two fittings mechanically connected to the envelope as externally accessable accoutrements thereof, said two fittings being spaced from one another about the perhiphery of the envelope;

each fitting including a first and a second electrical terminal and dielectric means electrically insulating these terminals from one another;

two electrical conductors respectively wired in parallel within said envelope one between corresponding first electrical terminals of said two fittings and the other between corresponding second electrical terminals of said two fittings; and at least one incandescent filament means provided across said two electrical conductors within said envelope;

means mechanically connecting one said fitting of one of said light bulbs to a respective other said fitting of the other of said light bulbs with the corresponding first electrical terminals of the one and other said fittings of said one and other light bulbs being electrically connected to one another and with the corresponding second electrical terminals of the one and other said fittings of said one and other light bulbs being electrically connected to one another.

8. The lighting system of claim 7, wherein: for each said light bulb, at least one of said fittings is constituted by a generally cylindrical base having a sidewall and an outer end wall, one of said electrical terminals thereof comprising an externally threaded tube of electrically conductive material providing at least a respective portion of said sidewall, and the other of said electrical terminals thereof comprising a centrally located boss of electrically conductive material providing a respective portion of said outer end wall, and said dielectric means being provided as an annulus mechanically bridging between said boss and said sidewall.

9. The lighting system of claim 8, wherein: for each said light bulb, said at least one fitting is constituted by both of said fittings; and said means mechanically connecting a said fitting of one said light bulb to a said fitting of the other said light bulb comprises a connector including a body having externally excessible means provided thereon, with spacing from one another, defining two generally cylindrical sockets each having a sidewall and an inner end wall, one of said electrical terminals thereof comprising an internally threaded tube of electrically conductive material providing at least a respective portion of said sidewall, and the other of said electrical terminals thereof comprising a centrally located boss of electrically conductive material providing a respective portion of said inner end wall, and said dielectric means being provided as an annulus mechanically bridging between said boss and said sidewall;

first electrical conductor means within said body electrically interconnecting the respective one electrical terminals of said sockets of said connector; and second electrical conductor means within said body electrically interconnecting the respective other electrical terminals of said sockets of said connector;

the two bulbs being mechanically connected to one another via said connector by each having a respective fitting thereof screwed into a respective socket of said connector.

10. The lighting system of claim 8, wherein:

said body of said connector is elongated with said sockets of said connector being provided at two opposite ends thereof.

11. The lighting system of claim 10, wherein:

said body is straight so that said sockets of said connector open axially outwardly of the body at substantially 180° to one another.

12. The lighting system of claim 10, wherein:

said body is intermediately angulated so that said sockets of said connector open axially outwardly of the body at other than an angle of 180° to one another.

13. The lighting system of claim 12, wherein:

said sockets of said connector open at an angle of substantially 90° to one another.

14. The lighting system of claim 8, wherein:

the connector body is further provided with means defining a third electrical socket having a sidewall and an inner end wall, one of said electrical terminals thereof comprising an internally threaded tube of electrically conductive material providing at least a respective portion of said sidewall, and the other of said electrical terminals thereof comprising a centrally located boss of electrically conductive material providing a respective portion of said inner end wall, and said dielectric means being provided as an annulus mechanically bridging between said boss and said sidewall;

third electrical conductor means within said body electrically interconnecting the respective one electrical terminal of said third electrical socket with said first electrical conductor means within said body, and fourth electrical conductor means within said body electrically interconnecting the respective other electrical terminal of said third electrical socket with said second electrical conductor means with said body.

15. The lighting system of claim 14, wherein:

said body is generally Y-shaped so as to have three ends at least two of which are disposed at non-180° angles to one another, the three socket means of said connector being provided so as to open axially outwardly at the three respective ends of said arms.

16. The lighting system of claim 9, wherein:

said body of said connector is elongated with said sockets of said connector being provided at two opposite ends thereof; and said body having an intermediate flexible portion so that said sockets of said connector, opening axially outwardly of the body at opposite ends thereof may be variably angled and offset with respect to one another by flexure of said body at said flexible portion thereof.

17. The lighting system of claim 9, further including:

a mechanical suspension strap connected at one end thereof to said connector and being constructed and arranged to hangingly support said lighting system.

18. The lighting system of claim 17, further including:

a second said connector mechanically and electrically connected with a respective second said fitting of one of said light bulbs; and said mechanical suspension strap being connected at another end thereof to said second connector and arching between the two said ends thereof whereby said mechanical suspension strap is constructed and arranged to hangingly support said lighting system.

19. The lighting system of claim 7, wherein: for each said light bulb, said at least one fitting is constituted by one of said fittings and the other of said fittings is constituted by means providing a generally cylindrical socket having a sidewall and an inner end wall, one of said electrical terminals thereof comprising an internally threaded tube of electrically conductive material providing at least a respective portion of said sidewall, and the other of said electrical terminals thereof comprising a centrally located boss of electrically conductive material providing a respective portion of said inner end wall, and said dielectric means being provided as an annulus mechanically bridging between said boss and said sidewall;

said mechanically connecting means being constituted by said base of the corresponding fitting of one of said bulbs being screwed directly into the socket of the corresponding fitting of the other of said bulbs.

20. The lighting system of claim 7, wherein: for each light bulb, one of said fittings is constituted by a generally cylindrical base having a sidewall and an outer end wall, one of said electrical terminals thereof comprising a tube of electrically conductive material providing at least a respective portion of said sidewall, and the other of said electrical terminals thereof comprising a centrally located boss of electrically conductive material providing a respective portion of said outer end wall, and said dielectric means thereof being provided as an annulus mechanically bridging between said boss and said sidewall;

said one fitting further including a first mechanical connector means externally provided on said sidewall thereof;

the other of said fittings being constituted by means defining a generally cylindrical socket having a sidewall and an inner end wall, one of said electrical terminals thereof comprising a tube of electrically conductive material providing at least a respective portion of said sidewall, and the other of said electrical terminals thereof comprising a centrally located boss of electrically conductive material providing a respective portion of said inner end wall, and said dielectric means thereof being provided as an annulus mechanically bridging between said boss and said sidewall;

said other fitting further including a second mechanical connector means provided on said sidewall so as to be accessable from within said socket;

said one and other fittings generally corresponding to one another in a complementary manner;

said one fitting of one of said bulbs accepting and both electrically parallelly connecting with and mechanically connecting with the respective other said fitting of the other of said bulbs.

21. A lighting system, comprising:

at least one bifitted incandescent electric light bulb, comprising:

means constituting an envelope including light-transmitting wall means;

two fittings mechanically connected to the envelope as externally accessable accoutrements thereof, said two fittings being spaced from one another about the periphery of the envelope;

each fitting including a first and a second electrical terminal and dielectric means electrically insulating these terminals from one another;

two electrical conductors respectively wired in parallel within said envelope one between corresponding first electrical terminals of said two fittings and the other between corresponding second electrical terminals of said two fittings; and at least one incandescent filament means provided across said two electrical conductors within said envelope;

at least one of said fittings is constituted by a generally cylindrical base having a sidewall and an outer end wall, one of said electrical terminals thereof comprising an externally threaded tube of electrically conductive material providing at least a respective portion of said sidewall, and the other of said electrical terminals thereof comprising a centrally located boss of electrically conductive material providing a respective portion of said outer end wall, and said dielectric means being provided as an annulus mechanically bridging between said boss and said sidewall; and a fitting terminator comprising body means providing a generally cylindrical socket having a sidewall and an inner end wall, two electrical terminals including one provided on a respective portion of said sidewall and another provided on a respective portion of said end wall, and means in said body means electrically connecting said two electrical terminals of said fitting terminator;

said fitting terminator being screwed onto one of said fittings of said bulb so as to electrically connect the said terminals of that fitting with one another.

22. A lighting system, comprising:

at least one bifitted incandescent electric light bulb, comprising:

means constituting an envelope including light-transmitting wall means;

two fittings mechanically connected to the envelope as externally accessable accoutrements thereof, said two fittings being spaced from one another about the periphery of the envelope;

each fitting including a first and a second electrical terminal and dielectric means electrically insulating these terminals from one another;

two electrical conductors respectively wired in parallel within said envelope one between corresponding first electrical terminals of said two fittings and the other between corresponding second electrical terminals of said two fittings; and at least one incandescent filament means provided across said two electrical conductors within said envelope;

at least one of said fittings is constituted by a generally cylindrical base having a sidewall and an outer end wall, one of said electrical terminals thereof comprising an externally threaded tube of electrically conductive material providing at least a respective portion of said sidewall, and the other of said electrical terminals thereof comprising a centrally located boss of electrically conductive material providing a respective portion of said outer end wall, and said dielectric means being provided as an annulus mechanically bridging between said boss and said sidewall;

said at least one fitting is constituted by one of said fittings and the other of said fittings is constituted by means providing a generally cylindrical socket having a sidewall and an inner end wall, one of said electrical terminals thereof comprising an internally threaded tube of electrically conductive material providing at least a respective portion of said sidewall, and the other of said electrical terminals thereof comprising a centrally located boss of electrically conductive material providing a respective portion of said inner end wall, and said dielectric means being provided as an annulus mechanically bridging between said boss and said sidewall;

a fitting terminator comprising body means providing a generally cylindrical base having a side wall and an outer end wall, two electrical terminals including one provided on a respective portion of said sidewall and another provided on a respective portion of said end wall, and means in said body means electrically connecting said two electrical terminals of said fitting terminator;

said fitting terminator being screwed into one of said fittings of said bulb so as to electrically connect the said terminals of that fitting with one another.

* * * * *